US010036604B2

(12) United States Patent
Cano

(10) Patent No.: US 10,036,604 B2
(45) Date of Patent: Jul. 31, 2018

(54) SYSTEMS AND METHODS FOR A PALM FIREARM

(71) Applicant: Jacinto Cano, Channelview, TX (US)

(72) Inventor: Jacinto Cano, Channelview, TX (US)

( * ) Notice: Subject to any disclaimer, the term of this patent is extended or adjusted under 35 U.S.C. 154(b) by 0 days.

(21) Appl. No.: 15/809,078

(22) Filed: Nov. 10, 2017

(65) Prior Publication Data

US 2018/0135931 A1 May 17, 2018

Related U.S. Application Data

(60) Provisional application No. 62/423,078, filed on Nov. 16, 2016.

(51) Int. Cl.
*F41A 19/21* (2006.01)
*F41A 19/14* (2006.01)
*F41A 3/60* (2006.01)

(52) U.S. Cl.
CPC ..... *F41A 19/21* (2013.01); *F41A 3/60* (2013.01); *F41A 19/14* (2013.01)

(58) Field of Classification Search
CPC .. F41C 9/02; F41A 19/21; F41A 19/18; F41A 19/19; F41A 3/60
USPC ..... 42/69.02, 69.01, 1.09, 42.01–42.03, 41
See application file for complete search history.

(56) References Cited

U.S. PATENT DOCUMENTS 1,637,079 A * 7/1927 Karner, Jr. ..... F41A 19/22 42/1.08
3,597,870 A * 8/1971 Block ..... F41A 19/21 42/106
4,283,873 A * 8/1981 McIntyre ..... F41A 3/58 42/12
4,400,900 A * 8/1983 Hillberg ..... F41A 19/23 42/42.03
4,722,148 A * 2/1988 Walker ..... F41A 19/23 42/40
5,225,611 A * 7/1993 Scott ..... F41A 19/23 42/42.03
7,905,042 B2 * 3/2011 Carmel ..... F41A 19/10 42/1.09
8,434,255 B2 * 5/2013 Kefer ..... F41A 17/70 42/69.01
8,782,938 B2 * 7/2014 Teach, Jr. ..... F41A 3/58 42/41
8,997,390 B1 * 4/2015 Heizer ..... F41A 3/58 42/42.03
9,175,918 B2 * 11/2015 Heizer ..... F41A 19/23
9,335,110 B1 * 5/2016 Heizer ..... F41A 19/29

* cited by examiner

*Primary Examiner* — Reginald Tillman, Jr.
(74) *Attorney, Agent, or Firm* — Pierson IP, PLLC

(57) ABSTRACT

Examples of the present disclosure are related to systems and methods for a palm firearm. More specifically, embodiments are directed towards a two shot firearm with a series of linkages and slide mechanisms to engage firing pins, which may reduce the size of the firearm while retaining the firearm's effectiveness.

20 Claims, 20 Drawing Sheets

SYSTEMS AND METHODS FOR A PALM FIREARM

CROSS-REFERENCE TO RELATED APPLICATIONS

This application claims a benefit of priority under 35 U.S.C. § 119 to Provisional Application No. 62/423,078 filed on 16 Nov. 2016, which is fully incorporated herein by reference in its entirety.

BACKGROUND INFORMATION

Field of the Disclosure

Examples of the present disclosure are related to systems and methods for a palm firearm. More specifically, embodiments are directed towards a two shot firearm with a series of linkages and slide mechanisms to engage firing pins, which may reduce the size of the firearm while retaining the firearm's effectiveness.

Background

A pocket pistol is a term for any small sized firearm. Typically pocket pistols are of a small caliber and are suitable for concealed carry. Conventional pocket pistols maintain a grip, slide, and other components that cause the firearm to increase in size. However, pocket pistols have a reduced barrel length, which reduces a fired projectile's velocity and accuracy.

Furthermore, conventional pocket pistols have a recoil line positioned over a user's hand. When the pocket pistol is fired, the user's wrist moves back due to the recoil line, lack of weight behind the pocket pistol, and the conventional way of holding the pocket pistol. One solution to this issue is to increase the grip size. However, this increases the size and bulkiness of the weapon.

Accordingly, needs exist for more effective and efficient systems and methods for a palm firearm with a vertical firing pin selector, wherein the vertical firing pin selector is configured to ignite a first primer associated with a first chamber that is vertically offset from a second primer associated with a second chamber

SUMMARY

Embodiments disclosed herein describe systems and methods for a firearm with a vertical firing pin selector, which is configured to reduce the size of the firearm. By incorporating a vertical firing pin selector within the firearm, embodiments may be more ergonomic and compact while retaining effectiveness and accuracy.

Elements of embodiments may be contained in a firearm housing that is substantially rectangular in shape, wherein the firearm housing may not include an extended grip. First ends of a first and second barrel may be positioned on a first end of the firearm housing. The barrels may extend towards a second end of the firearm housing, wherein a first barrel may be vertically offset from a second barrel.

A vertical firing pin selector may be positioned proximate to a second end of the firearm housing. The vertical firing pin selector may extend upward in a direction that is perpendicular to the longitudinal axis of the barrels. In embodiments, other elements of the firearm may be positioned below the barrels and the vertical firing pin, reducing the size of the firearm.

In use, a user may position their index finger on a groove on an outer surface of the barrel, their middle finger on the trigger, and their ring finger may wrap around an indentation on a lower edge of the firearm housing. This helps to instinctively be on target faster than by using sights. The natural pointing of the finger guides the weapon. It also helps with muzzle rise and recoil as the line of recoil and pistol are enveloped inside the hand. Responsive to a user pressing the trigger, a hammer may vertically strike the vertical firing pin selector via a transfer bar. The vertical movement of the hammer may move the vertical firing pin selector to strike a selected firing pin to ignite a primer.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
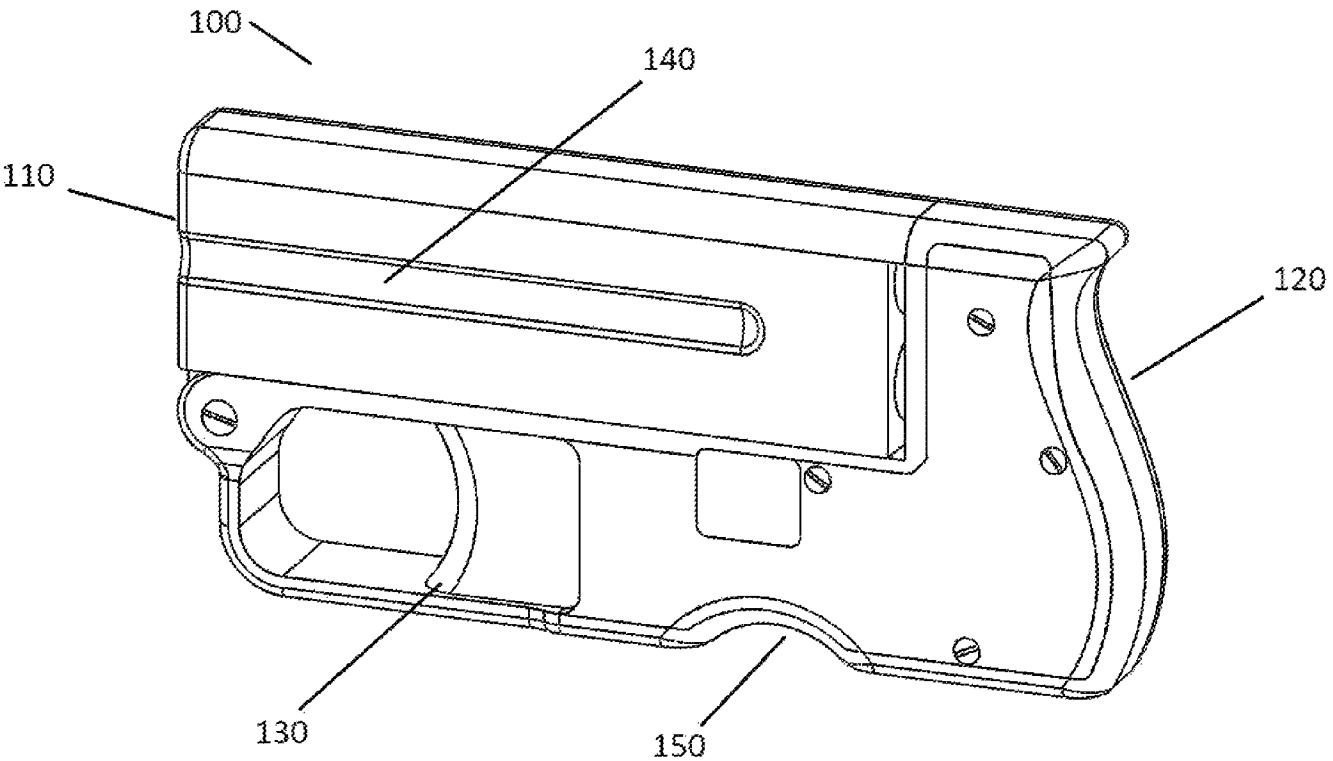
FIG. 1 depicts a perspective view of a compact firearm housing, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

FIG. 1 depicts a perspective view of a compact firearm housing 100, according to an embodiment. Although not depicted in FIG. 1, second side of firearm housing 100 may be substantially symmetrical to the first side of firearm housing 100.

As depicted in FIG. 1, firearm housing 100 may be substantially rectangular in shape with a longer longitudinal axis than height. When in use, firearm housing 100 may be configured to be held in a user's hand. Firearm housing 100 may include a first end 110, second end 120, trigger 130, groove 140, and indent 150.

First end 110 of firearm housing 100 may be a distal end of firearm housing 100, and may have a substantially flat face. In embodiments, barrels associated with firearm housing 100 may extend from first end 110 towards second end 120 of firearm housing 100, wherein the barrels may be vertically offset from each other in parallel planes. However, the barrels may not extend across the entirety of the longitudinal axis of firearm housing 100.

Second end 120 of firearm housing 100 may be a proximal end of firearm housing 100, and second end 120 may include a double curved surface. The double curved surface may be configured to ergonomically sit within a user's palm when in use. An upper end of second end 120 may include a concave curve that extends within firearm housing 100, and a lower end of second end 120 may include a convex curve that protrudes away from firearm housing 100.

Trigger 130 may be positioned proximate to first end 110 of firearm housing 100, wherein trigger 130 may be positioned within a cutout of firearm housing 100. Trigger 130 may be configured to be pressed to move towards second end 120. Responsive to no longer applying the force to trigger 130, a spring or other linear moving mechanism may move trigger 130 towards first end 110. This may reset firearm 100.

Groove 140 may be a channel, trench, etc. positioned on a sidewall of firearm housing 100. Groove 140 may extend from first end 110 towards second end 120. Groove 140 may be configured to receive a user's finger to more accurately aim firearm housing 100. In embodiments, groove 140 may extend in a direction in parallel with the barrels of firearm housing 100, and may be positioned between the barrels.

Indent 150 may be a concave cutout positioned on a lower surface of firearm housing 100. Indent 150 may be positioned more proximate to second end 120 than first end 110. Indent 150 may be configured to receive a user's finger to more accurately and comfortable hold firearm housing 100.

Figure 2:
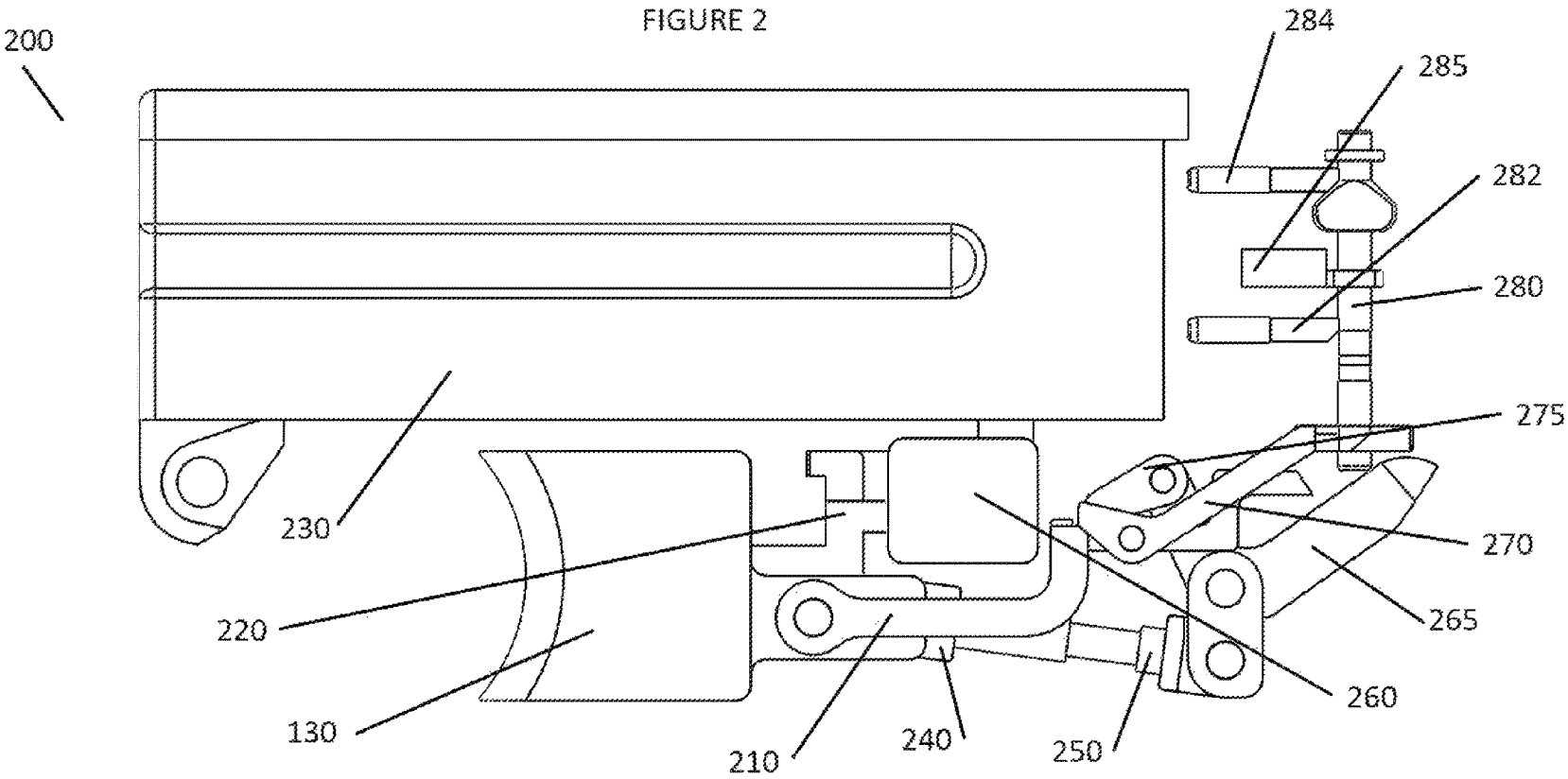
FIG. 2 depicts a first side view of internal elements of a firearm, according to an embodiment.

FIG. 2 depicts a first side view of internal elements of firearm 200, according to an embodiment. Elements depicted in FIG. 2 may be described above. For the sake of brevity, a further description of these elements is omitted.

Firearm 200 may include trigger 130, transfer bar 210, barrel lock 220, barrel 230, piston 240 with projection 250, barrel release button 260, hammer 265, turner 270, hammer pawl 275, vertical firing pin selector 280, first firing pin 282, second firing pin 284, and retainer block 285.

Transfer bar 210 may be configured to transfer mechanical energy from trigger 130 to turner 270 to turn vertical firing pin selector 280. Transfer bar 210 may transfer the energy in a direction that is perpendicular to vertical firing pin selector 280, and in parallel to the barrels. A first end of transfer bar 210 may be coupled to trigger 130, and a second end of transfer bar may be selectively coupled with turner 270 and hammer pawl 275. Responsive to a user pressing trigger 130, transfer bar 210 may correspondingly move along a linear axis from first end 110 towards second end 120. When transfer bar 210 moves towards second end 120, transfer bar 210 may move turner 270 and may allow hammer pawl 275 to be disengaged from transfer bar 210.

Turner 270 may be configured to turn vertical firing pin selector 280 responsive to trigger 130 being pressed. Turner 270 may have a first end coupled transfer bar 210, and have a second end that is selectively coupled to turning posts of vertical firing pin selector 280. Turner 270 may include an angled first end and a planar shaft. Responsive to trigger 130 being pressed, the planar shaft may move towards second end 120, engage with turning posts on vertical firing pin selector 280, and rotate firing pin selector 280. When trigger 130 is no longer pressed, the planar shaft may move towards first end 110 sliding slide under a turning post of vertical firing pin sector 280 to be reset. When resetting turner 270, hammer 265 may also be reset.

Piston 240 may be configured to transfer force from trigger 130 to hammer 265 to move hammer 265. Piston 240 may be configured to be coupled to firearm housing 100 via a post or coupling member protruding from firearm housing 100. A linear adjustable member 250, such as a spring, actuator, etc., may be positioned on a second end of piston 240, and may be configured to be elongated and compressed. Responsive to pressing trigger 130, linear adjustable member 250 may be compressed to apply force to hammer 265. The force applied by linear adjustable member 250 when trigger 130 is pressed may be from front end 110 towards second end 120 such that linear adjustable member 250 is pushed into piston 240. Responsive to trigger 130 no longer being pressed, linear adjustable member 250 may apply force towards first end 110 of housing 100, becoming elongated, to reset trigger 130.

Hammer 265 may be an element of firearm 200 that is configured to convert stored potential energy into an initial source of energy to fire a projectile. Hammer 265 may be substantially "Y" shaped, with three prongs. A first prong of hammer 265 may be coupled with linear adjustable member 250, a second prong may be coupled with hammer pawl 275, and a third prong may be configured to move the vertical firing pin selector 280 via transfer bar 210 to transfer the moving energy of the third prong when the trigger 130 is pressed to the release hammer 265. Responsive to trigger 130 being pressed, hammer pawl 275 may push the second prong towards second end 120, which may correspondingly pull first prong towards first end 110 while compressing linear adjustable member 250. This may also cause the third prong to initially rotate away from vertical firing pin selector 280.

Once the vertical firing pin selector 280 selects a firing pin and hammer pawl 275 slips up from the protrusion/stopper that is on top of transfer bar 210 because of its limited turning, linear adjustable member 250 may push the second prong towards first end 120, the first prong may move downwards towards stopper 310, and the third prong may rotate upward to strike vertical firing pin selector 280 via transfer bar 210. This may cause the vertical firing pin selector 280 to be pushed upward to ignite a primer associated with the projectile within a corresponding barrel.

Hammer pawl 275 may be configured to be coupled with the second prong of hammer 265, and selectively coupled with transfer bar 210. When trigger 130 is not pressed, a first end of hammer pawl 275 may be positioned adjacent to a stopper within transfer bar 210, which may limit the movement of hammer pawl 275 towards first end 110. Responsive to pressing trigger 130, hammer pawl 275 may rotate above the stopper and be positioned over the stopper after it reaches its turning limit with hammer 265. In embodiments, hammer pawl 275 may be shaped such that right before trigger 130 is fully pressed, hammer pawl 275 may slip up from the stopper. Hammer pawl 275 may no longer rotate in the post of the hammer because the rear end of hammer pawl 275 is unable to rotate based on the hammer and the shape of hammer pawl 275. This may allow the third prong to rotate upward. Responsive to no longer pressing the trigger 130, hammer pawl 275 may slide over the stopper until the first end of hammer pawl 275 is positioned adjacent to the stopper once again.

Vertical firing pin selector 280 may be configured to rotate to select a firing pin, and also to strike the selecting firing pin to ignite a primer associated with a projectile within a corresponding barrel.

A first end of vertical firing pin selector 280 may include a set of turning posts. The turning posts may be offset by ninety degrees, wherein a first set of turning posts is associated with first firing pin 282, and a second set of turning posts is associated with second firing pin 284. A front face of the turning posts may be planar, and may be configured to rotate responsive to receiving force from turner 270 when trigger 130 is pressed. Responsive to the front face of a turning posts being rotated, vertical firing pin selector 280 may correspondingly rotate. A rear face of the turning posts may be angled, which may be configured to allow turner 270 to slide under the turning posts when trigger 130 is depressed without rotating vertical firing pin selector.

In embodiments, a spring (not shown) may be positioned at a top end of vertical firing pin selector 280. This spring may be configured to push vertical firing pin selector 280 downward. This may allow vertical firing pin selector 280 to rotate without hitting or catching the firing pins 282, 284. However, the vertical movement of hammer 265 may create a force greater than the spring force, which may allow vertical firing pin selector 285 to move against the force of the spring to strike a selected pin.

A shaft of vertical firing pin selector 280 may include a first pin selector, a second pin selector, and rotating projection. The first pin selector and the second pin selector may be substantially triangular shaped elements, with sloped legs. The first pin selector may be associated with the first firing pin 282, and the second pin selector may be associated with the second firing pin 284. The first pin selector and the second pin selector may be rotationally offset by one hundred and eighty degrees, such that both firing pins may not be simultaneously selected. Responsive to rotating vertical firing pin selector 280, a corresponding pin selector may rotate to engage with a corresponding firing pin. In embodiments, a pin selector may be engaged with a firing pin when the legs of the pin selector are positioned in parallel to barrel 230. Furthermore, the vertical firing pin selector 280 may engage with the firing pin by positioning a first leg of the pin selector against the engaged firing pin. When a pin selector is disengaged with the firing pin, the firing pin may be positioned adjacent to a shaft of the vertical firing pin selector 280 as to not engage with it when vertical firing pin selector 280 is struck. When the first pin selector is engaged with the first firing pin 282, another rotating of vertical firing pin selector 280 may cause the second pin selector to become engaged with the second firing pin 284.

Retainer block 285 may be configured to keep vertical firing pin selector 280 from turning except when turner 270 rotates vertical firing pin selector 280 ninety degrees with each turn. In embodiments, retainer block 285 may include a spring that is configured to apply force towards a rotating projection positioned on the shaft of vertical firing pin selector 280. This force against vertical firing pin selector 280 in a direction towards the proximal end of firearm 100 may allow the firing pins to selectively engage with the pin selectors. In embodiments, the rotating projection may be substantially square in shape with notched edges, and may be positioned perpendicular to a shaft of vertical firing pin selector 280.

Barrel 230 may be a tube or multiple tubes positioned within firearm housing 100, which are vertically offset from each other. Projectiles positioned with firearm housing 100 may be configured exit barrel 230 at a high rate of velocity. In embodiments, barrel 230 may include two barrels that are positioned on top of each other with a groove aligned parallel in between both barrels. A first barrel may be aligned with first firing pin selector 282, and a second barrel may be aligned with second firing pin selector 284. Barrel 230 may be coupled to a first end 110 of firearm housing 100 via a hinge. Responsive to unlocking barrel 230 via barrel lock 220, barrel 230 may rotate away from second end 120. When barrel 230 is positioned away from second end 120, projectiles may be inserted into the first barrel and or the second barrel.

Barrel lock 220 may be a device embedded within firearm housing 100 that is configured to limit the upward rotation of barrel 230. Barrel lock 220 may have a lip that is configured to be overlaid over a protrusion of barrel 230 when in the locked position. Responsive to pressing barrel release button 260, the lip may move forward towards first end 110 of firearm housing 100, such that the lip is no longer overlaid over the protrusion. By moving the lip forward, barrel 230 may be configured to rotate upwards.

Figure 3:
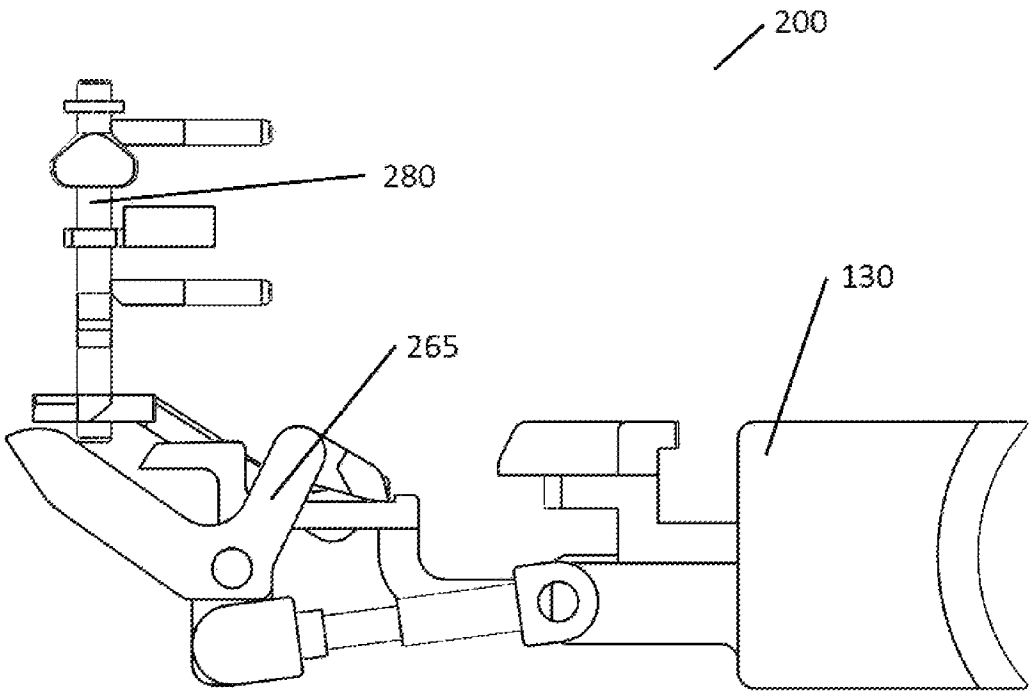
FIG. 3 depicts a second side view of internal elements of a firearm, according to an embodiment.

FIG. 3 depicts a second side view of internal elements of firearm 200, according to an embodiment. Elements depicted in FIG. 3 may be described above. For the sake of brevity, a further description of these elements is omitted.

As depicted in FIG. 3, a stopper 310 may be positioned on a lower surface of firearm housing 100. Stopper 310 may be configured to limit the rear ward movement of the first prong of hammer 265. Based on the positioned of stopper 310, when trigger 130 is pressed the third prong of hammer 265 may be vertically aligned with vertical firing pin selector 280 to vertically move vertical firing pin selector 280.

Figure 4:
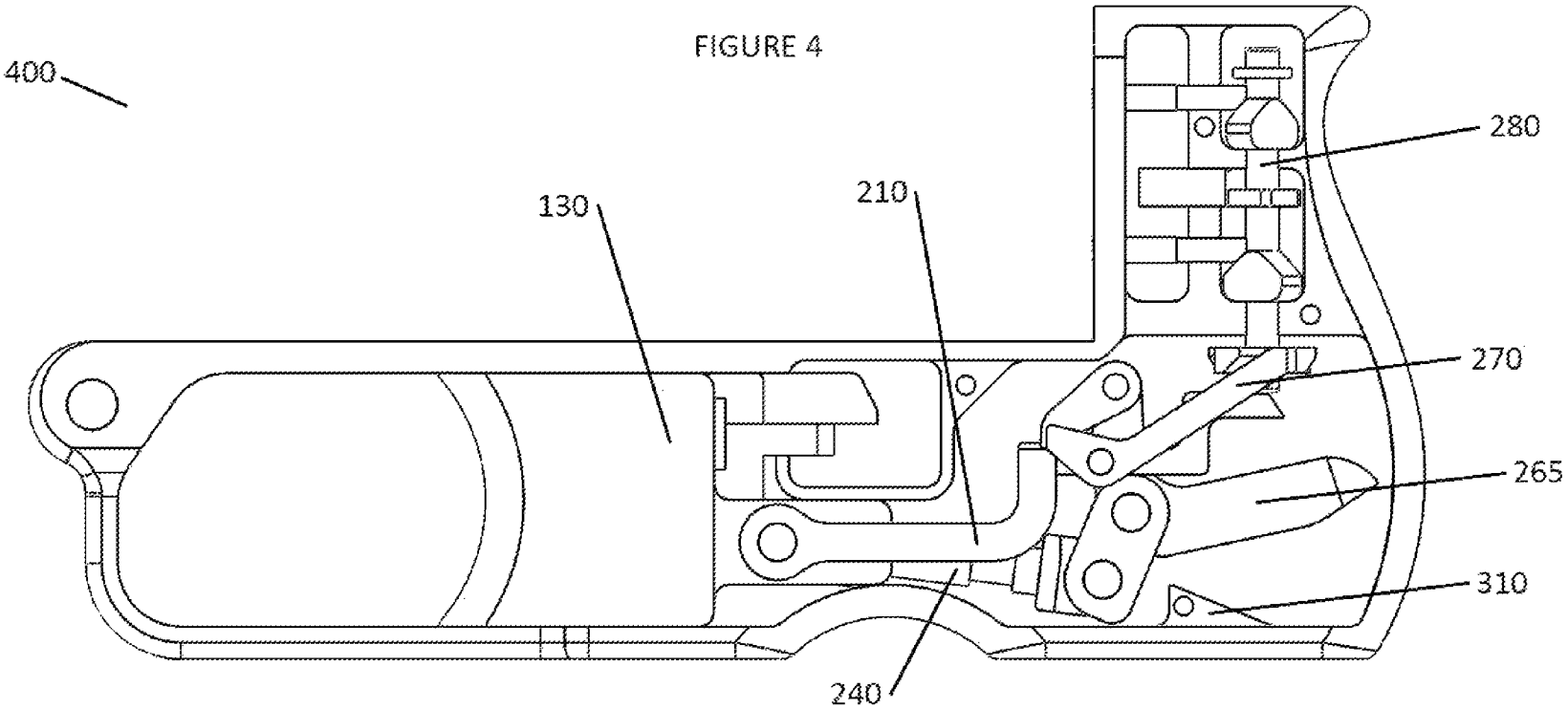
FIGS. 4 and 5 depict a first side view and a second side view of internal elements of firearm responsive to trigger being partially pressed, according to an embodiment.
Figure 5:
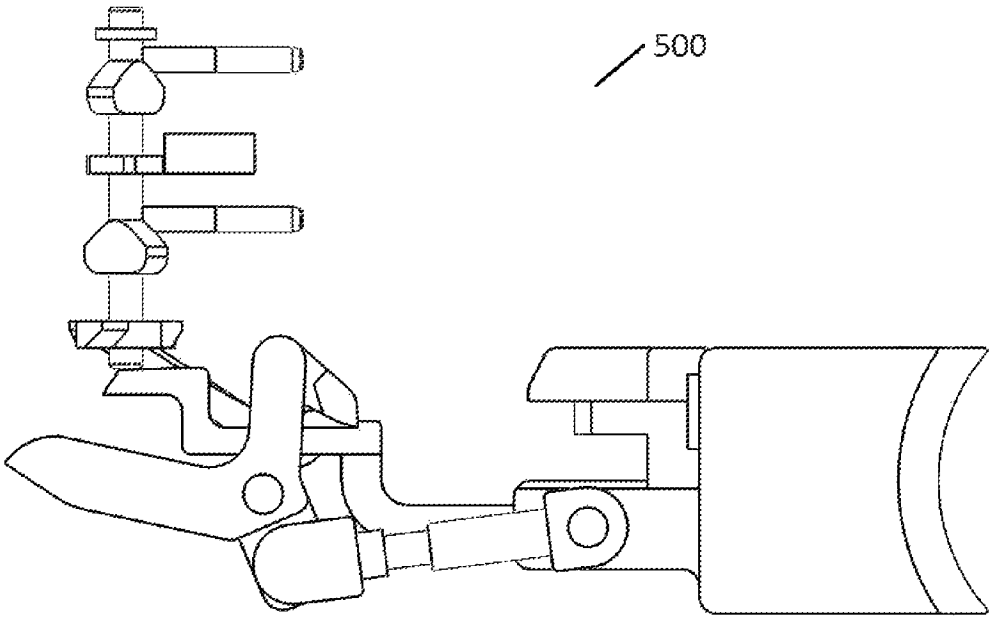

FIGS. 4 and 5 depict a first side view 400 and a second side view 500 of internal elements of firearm 200 responsive to trigger 130 being partially pressed. Elements depicted in FIGS. 4 and 5 may be described above. For the sake of brevity, a further description of these elements is omitted.

As depicted in FIGS. 4 and 5, when trigger 130 is initially depressed, transfer bar 210 may move turner 270 in a linear direction towards the proximal end of firearm, such that turner 270 applied pressure against vertical firing pin selector 280. The movement of turner 270 against vertical firing pin selector 280 to causes vertical firing pin selector 280 to rotate along an axis defined by the longitudinal axis of vertical firing pin selector 280, wherein the longitudinal axis of vertical firing pin selector 280 may be perpendicular to the longitudinal axis of the barrels. Furthermore, as transfer bar 210 is sliding rearward pushing hammer pawl 275 it causes hammer 265 to rotate, which may allow for the second prong of hammer 265 to move to the second end 120 of firearm 100 and third prong of hammer 265 to move downward towards the lower surface of firearm housing 100.

Figure 6:
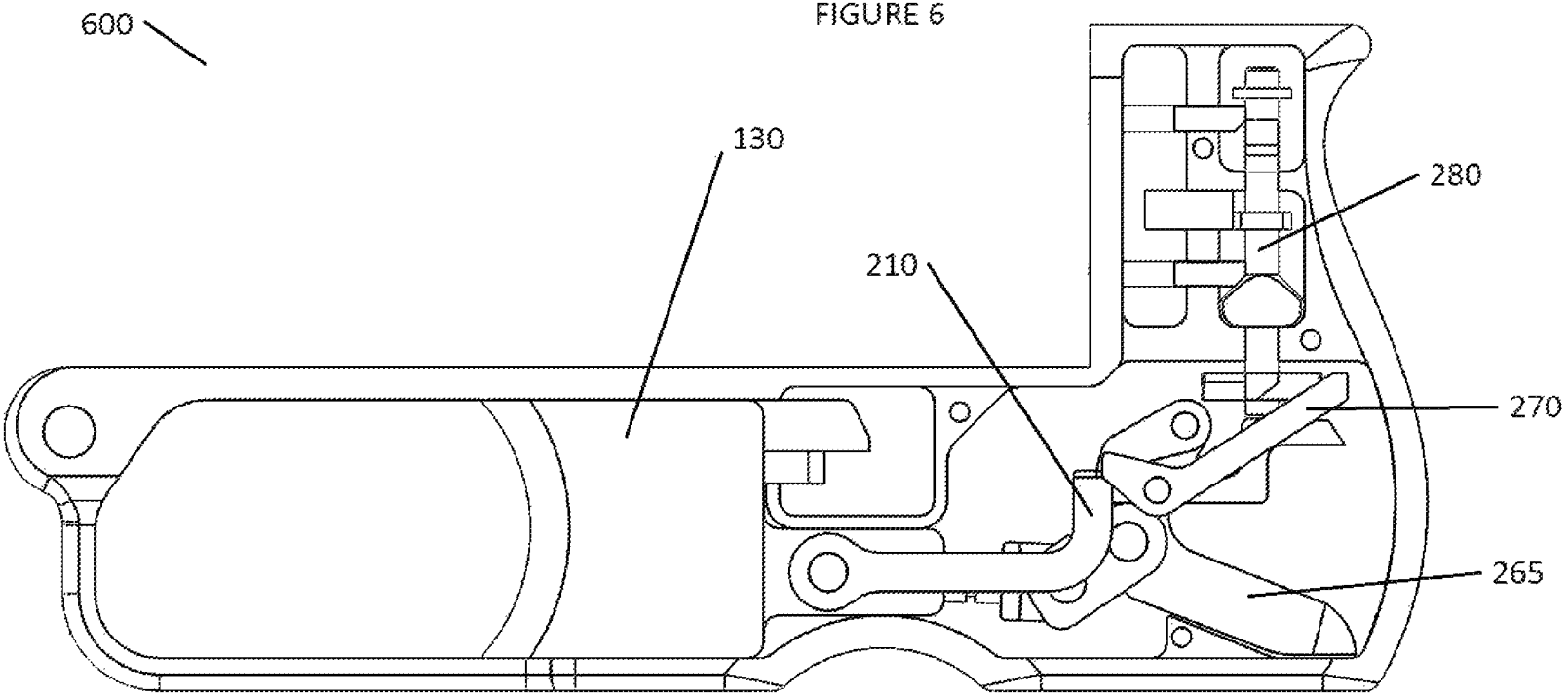
FIGS. 6 and 7 depict a first side view and a second side view of internal elements of a firearm responsive to a trigger being partially depressed, according to an embodiment.
Figure 7:
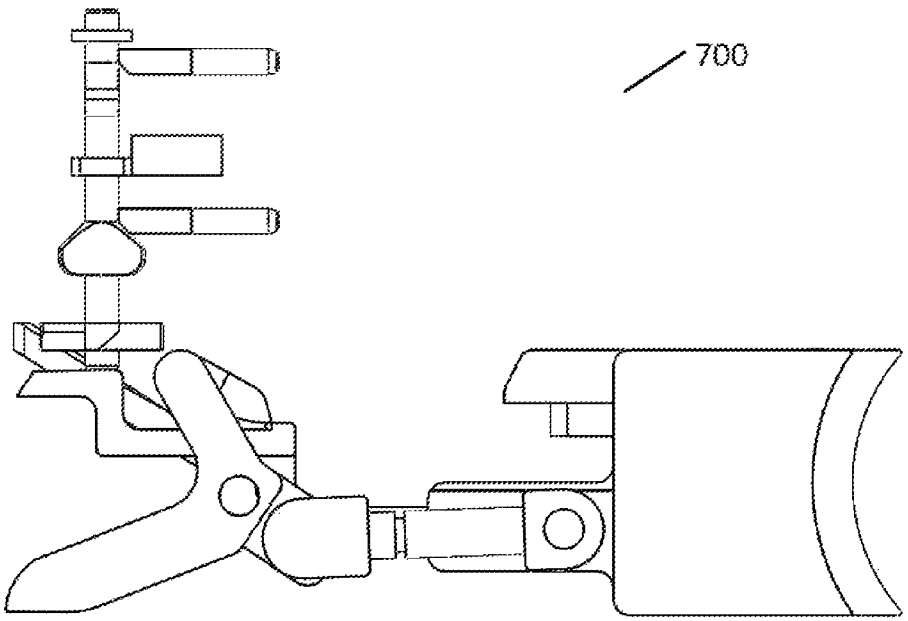

FIGS. 6 and 7 depict a first side view 600 and a second side view 700 of internal elements of firearm 200 responsive to trigger 130 being partially depressed. Elements depicted in FIGS. 6 and 7 may be described above. For the sake of brevity, a further description of these elements is omitted.

Embodiments depicted in FIGS. 6 and 7 may occur right before hammer pawl 275 slips out of the stopper of transfer bar 210. As depicted in FIGS. 6 and 7, when trigger 130 is further pressed towards second end 120 of firearm housing 100, the third prong of hammer 265 may be positioned adjacent to a lower surface of firearm housing 100.

Furthermore, transfer bar 210 may be further pushed towards second end 120 and allow it to be positioned under vertical firing pin selector 280. This may enable a second end of turner 270 to fully pass vertical firing pin selector 280, turning vertical firing pin selector 280 ninety degrees.

Figure 8:
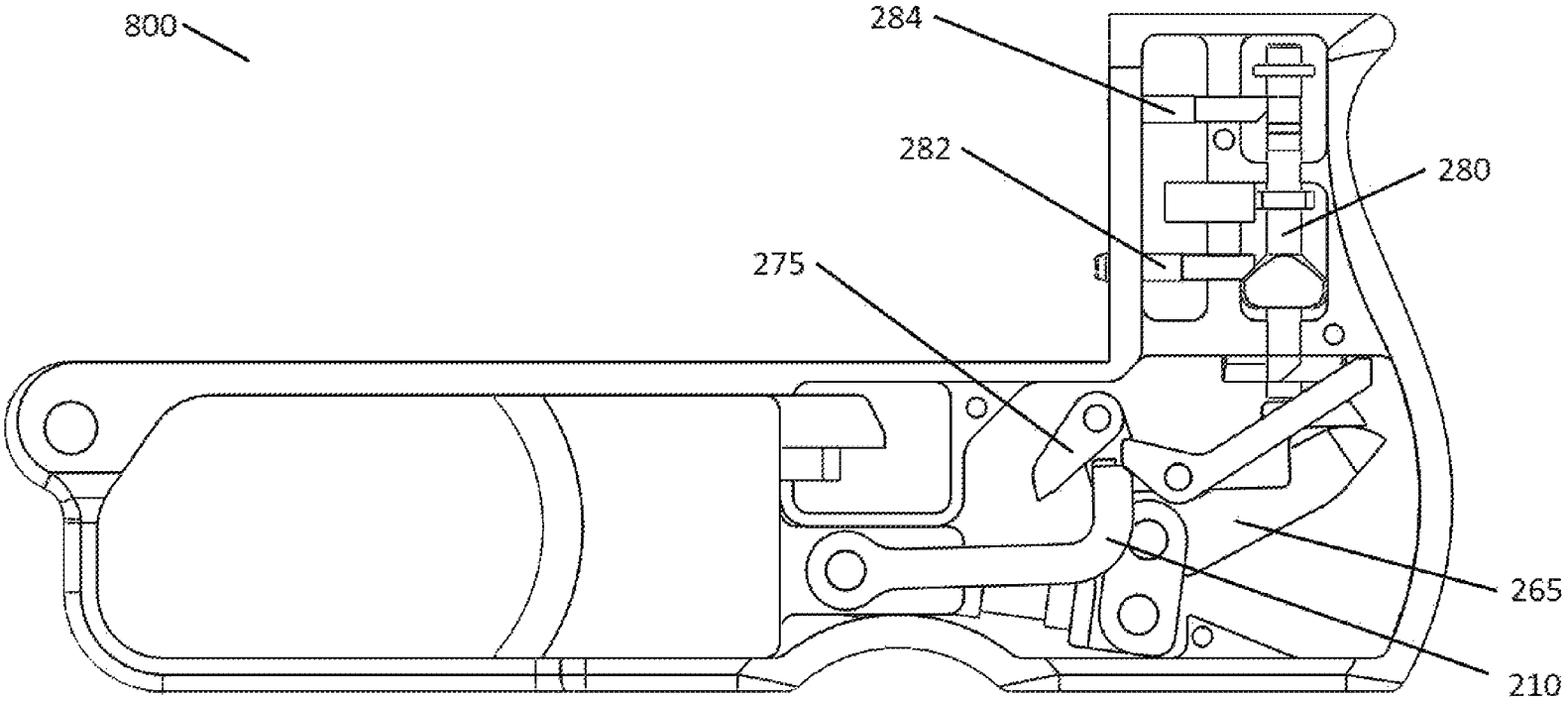
FIGS. 8 and 9 depict a first side view and a second side view of internal elements of a firearm responsive to a trigger being pressed, according to an embodiment.
Figure 9:
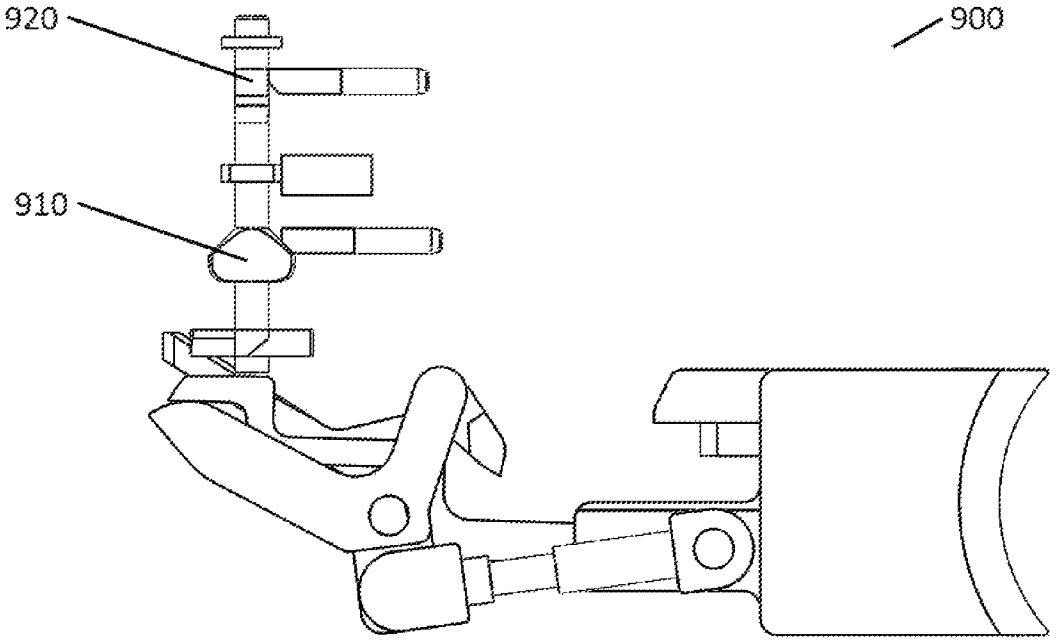

FIGS. 8 and 9 depict a first side view 800 and a second side view 900 of internal elements of firearm 200 responsive to trigger 130 being pressed. Elements depicted in FIGS. 8 and 9 may be described above. For the sake of brevity, a further description of these elements is omitted.

Embodiments depicted in FIGS. 8 and 9 may occur after hammer pawl 275 slips up from transfer bar 210 and hammer 265 is released. This may move firing pin 282 and igniting a primer.

Furthermore, hammer pawl 275 may be positioned over transfer bar 210. This may allow the third prong of hammer 265 to move vertically. When the third prong of hammer 265 moves vertically, hammer 265 may strike vertical firing pin selector 280 via transfer bar 210, wherein the third prong of hammer 265 may move in a vertical direction. In embodiments, the movement of third prong of hammer 265 may counter the shape of second end 120.

Responsive to the third prong of hammer 265 striking vertical firing pin selector 280 via transfer bar 210, the aligned first first pin selector 910 may push first firing pin 282 towards first end 110. As depicted in FIGS. 8 and 9, first firing pin 282 may protrude further towards first end than second firing pin 284. This may cause a primer associated with projectile positioned within the first barrel to be ignited. Furthermore, as depicted in FIG. 9, first firing pin selector 910 may be rotated such that the width of first firing pin selector 910 is greater than the width of second firing pin selector 920. This may enable first firing pin selector 910 to interact with first firing pin 282 without second firing pin 284 interacting with second firing pin 284. Similarly, as the turning post rotates vertical firing pin 280 ninety degrees, second firing pin selector 920 may interact with second firing pin 284 without first firing pin selector 910 interacting with first firing pin 282. This may be due to the rotational offset of first firing pin selector 910 and second firing pin selector 920.

Furthermore, the angled sidewalls of first firing pin selector 910 may be utilized to push first firing pin 282 forward when vertical firing pin selector 910 is raised. If vertical firing pin selector 910 is not being temporarily raised by hammer 265, then first firing pin 282 and second firing pin 284 may not be pushed forward.

Figure 10:
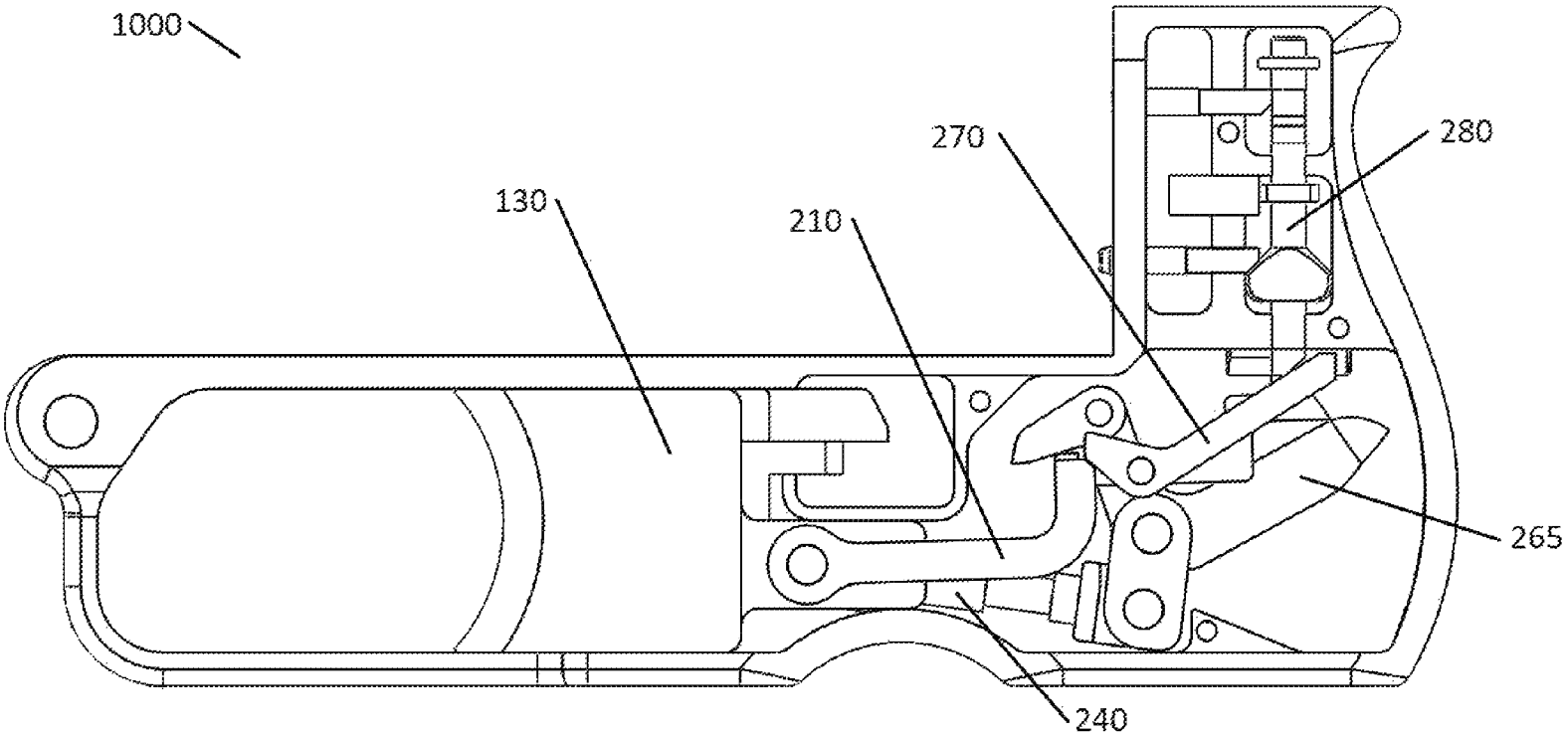
FIGS. 10 and 11 depict a first side view and a second side view of internal elements of a firearm responsive to a trigger being released, according to an embodiment.
Figure 11:
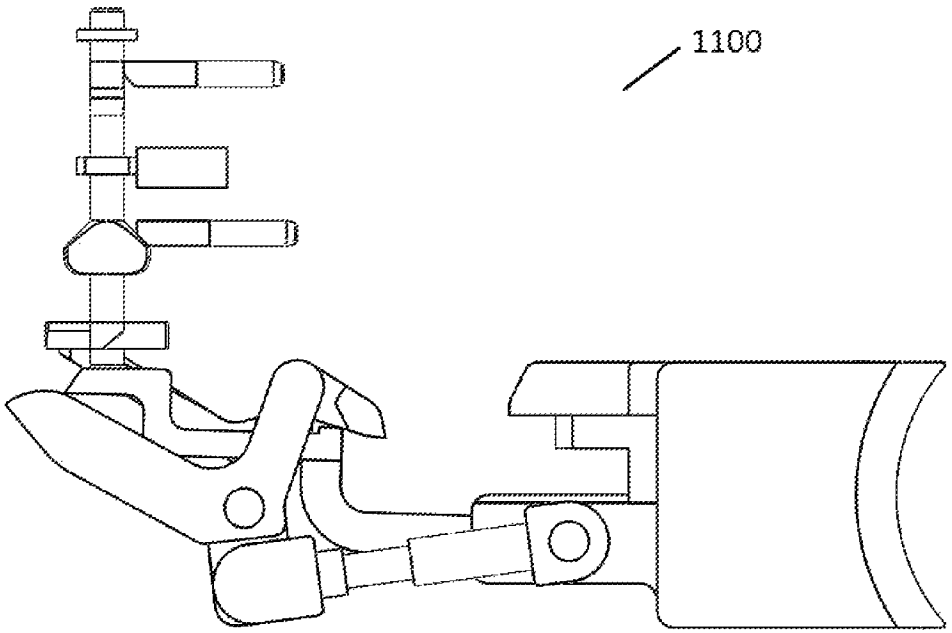

FIGS. 10 and 11 depict a first side view 1000 and a second side view 1100 of internal elements of firearm 200 responsive to trigger 130 being released. Elements depicted in FIGS. 10 and 9 may be described above. For the sake of brevity, a further description of these elements is omitted.

Figure 19:
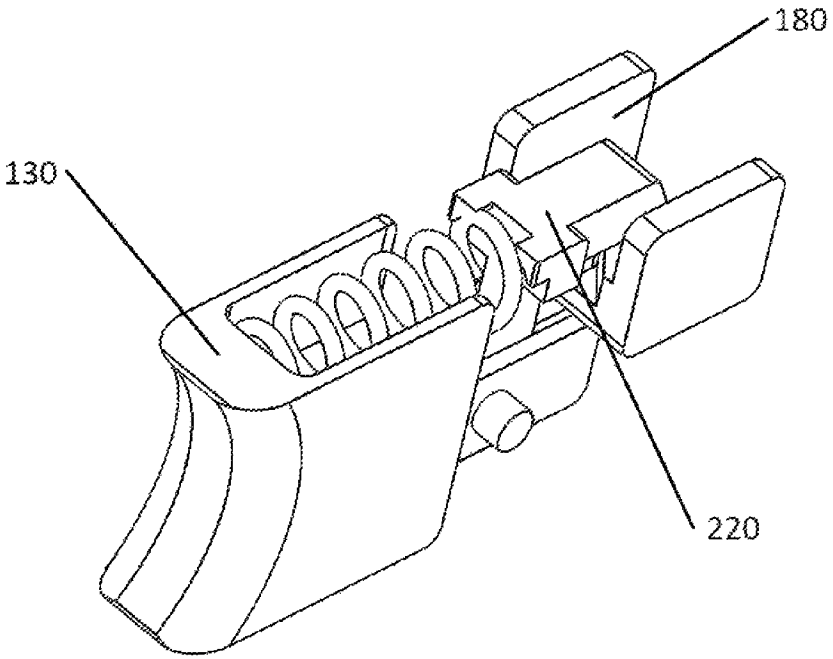
Figure 20:
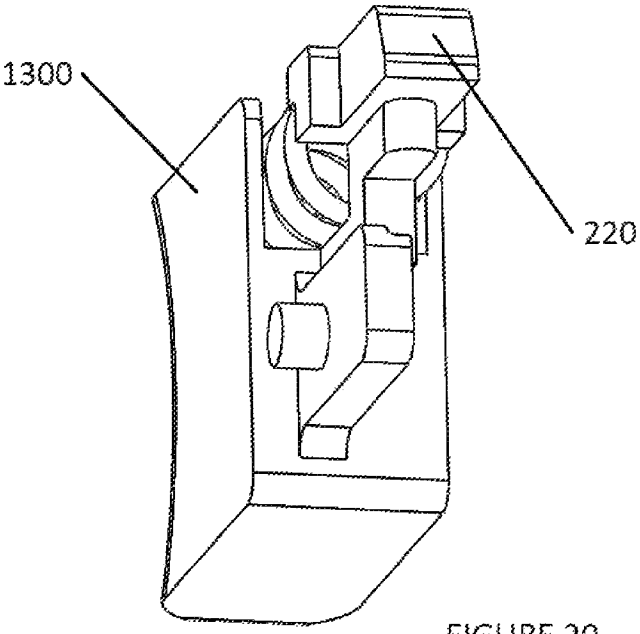

Embodiments depicted in FIGS. 10 and 11 illustrate how hammer 265 maintains pressure upward on the transfer bar 210, and parts above hammer 265 as trigger 13 and transfer bar 210 are moving towards first end 110. As depicted in FIGS. 10 and 11, responsive to releasing trigger 130, In embodiments, a spring (as depicted in FIGS. 19 and 20) may apply pressure on trigger 130, transfer bar 210, and turner 270 towards first end 110. This spring may also be configured to push barrel lock 220 back towards second end 120 to keep barrel 230 in the locked position. When turner 270 moves towards first end 110, turner 270 may slide under an angled sidewall of a rotator associated with vertical firing pin selector 280.

Furthermore, because hammer 265 is not applying pressure against vertical firing pin selector 280, neither first firing pin selector 910 or second firing pin selector 920 will be engaged with first or second firing pin 282, 284.

Figure 12:
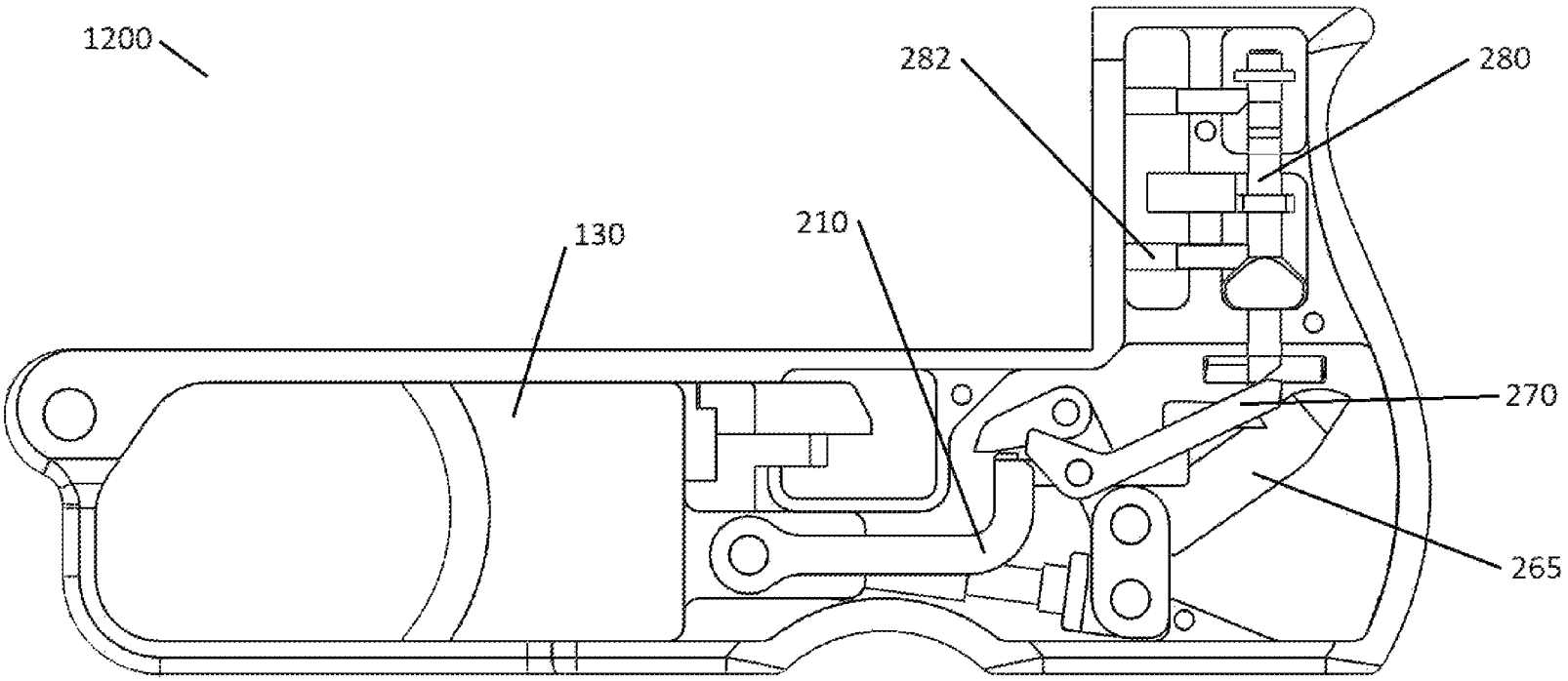
FIGS. 12 and 13 depict a first side view and a second side view of internal elements of a firearm responsive to a trigger being released, according to an embodiment.
Figure 13:
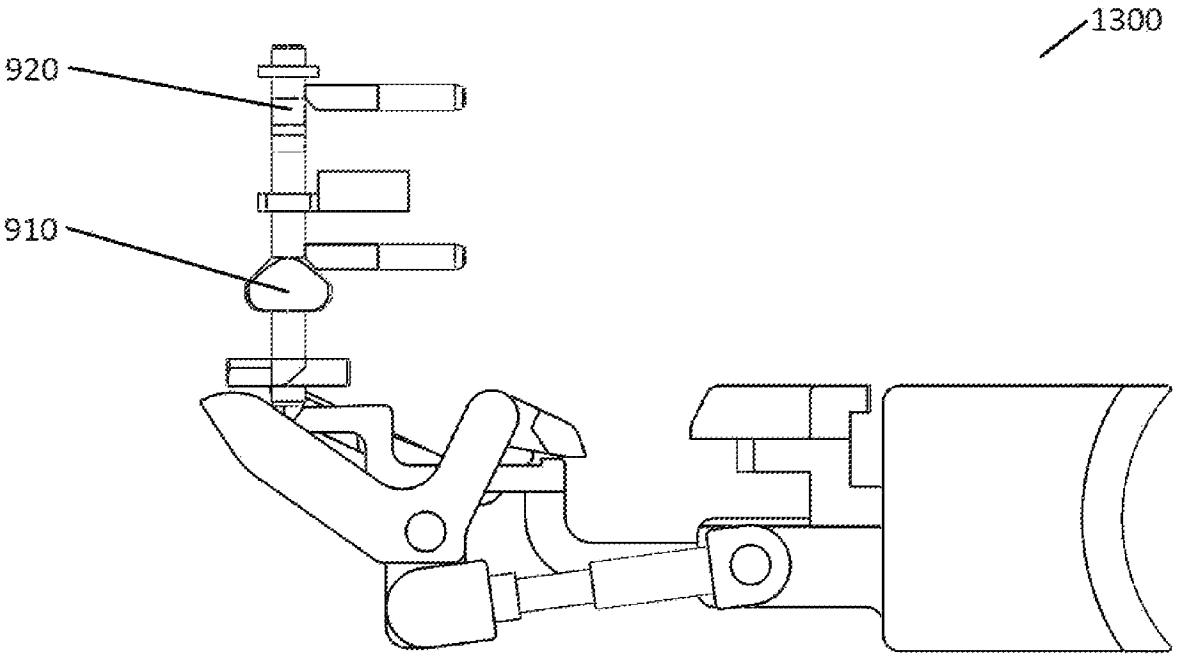

FIGS. 12 and 13 depict a first side view 1200 and a second side view 1300 of internal elements of firearm 200 responsive to trigger 130 being released. Elements depicted in FIGS. 12 and 13 may be described above. For the sake of brevity, a further description of these elements is omitted.

Embodiments depicted in FIGS. 12 and 13 may occur right after those depicted in FIGS. 10 and 11 when transfer bar 210 slips from being on top of hammer 265 and relieves pressure to vertical firing pin selector 280 and other elements positioned above it. This may occur when hammer 265 returns to rest on stopper 310. As depicted in FIGS. 12 and 13, responsive to moving trigger 130 towards first end 110, transfer bar 210 and turner 270 may correspondingly move. This movement may allow transfer bar 210 to dismount third prong of hammer 265, such that hammer 265 no longer raises vertical firing pin selector 280 and returns first prong to rest on stopper 310. Therefore, first firing pin 282 may not extend forward.

Figure 14:
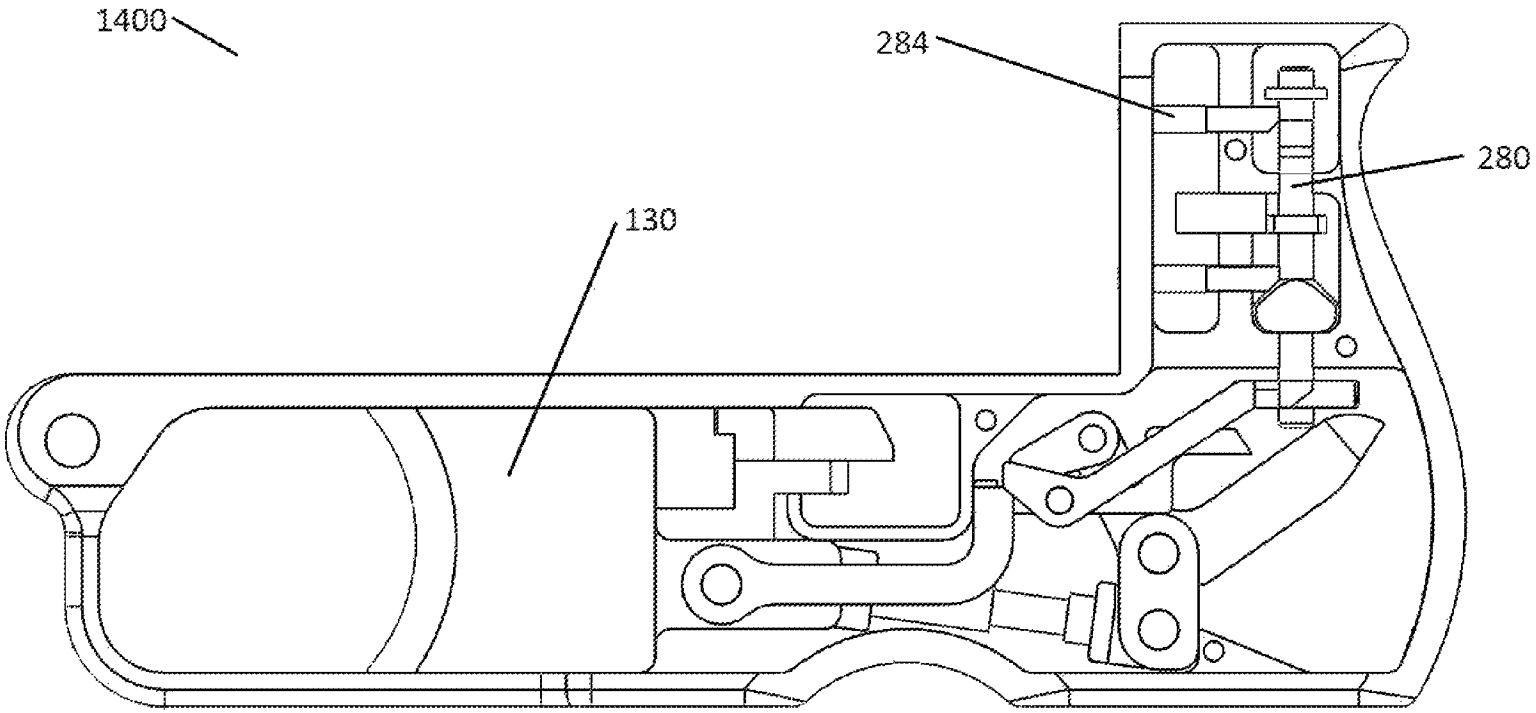
FIGS. 14 and 15 depict a first side view and a second side view of internal elements of a firearm responsive to a trigger being released and reset, according to an embodiment.
Figure 15:
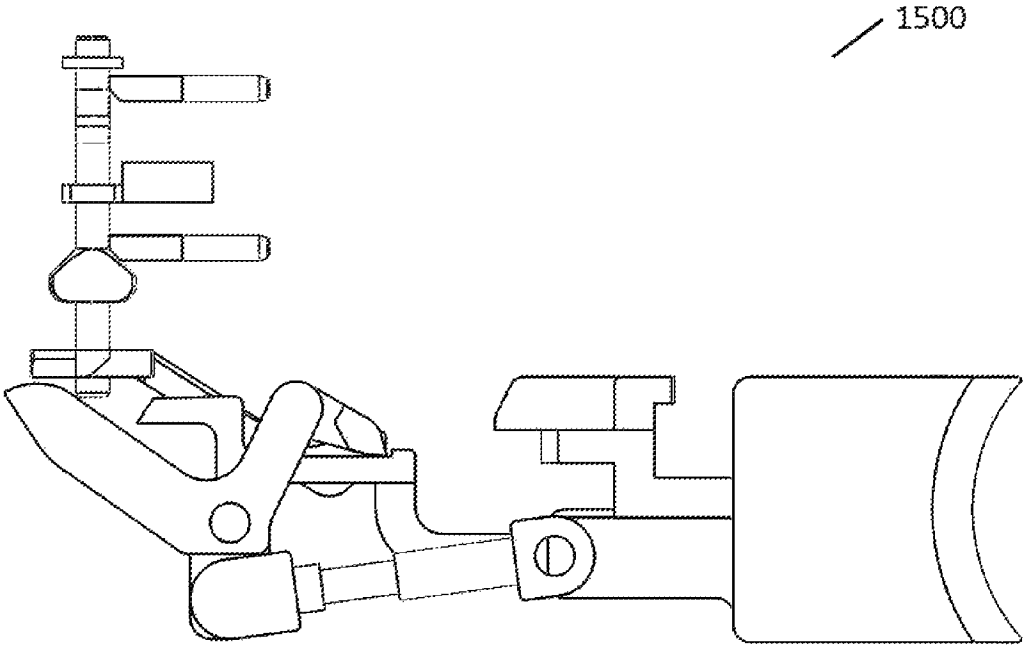

FIGS. 14 and 15 depict a first side view 1400 and a second side view 1500 of internal elements of firearm 200 responsive to trigger 130 being released and reset. Elements depicted in FIGS. 14 and 15 may be described above. For the sake of brevity, a further description of these elements is omitted.

As depicted in FIGS. 14 and 15, once trigger 130 is fully released firearm 200 may be reset. Responsive to pressing trigger 130 once again, the procedure described above may be performed again. However, in the second pass through, vertical firing pin selector 280 may select and engage with second firing pin 284. This may allow a projectile positioned in the uppermost barrel fired.

Figure 16:
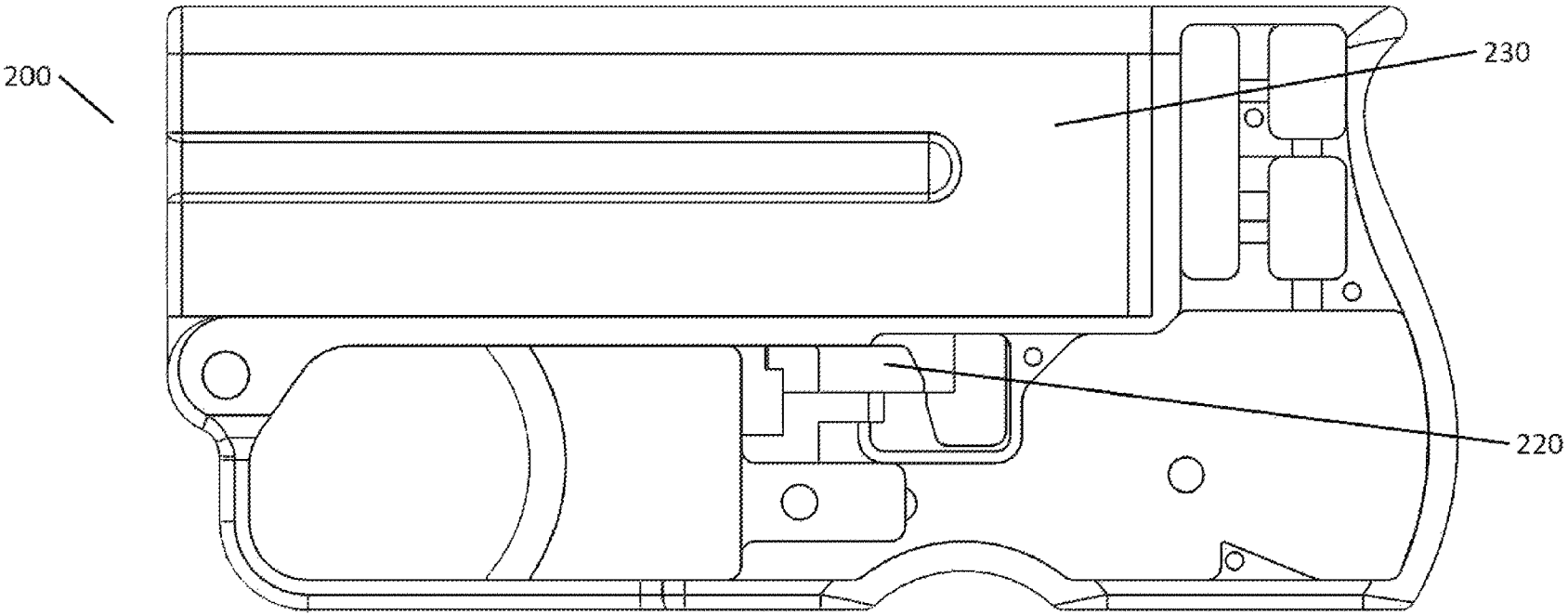
FIG. 16 depicts an embodiment of a firearm, wherein a barrel lock is released, according to an embodiment.
Figure 17:
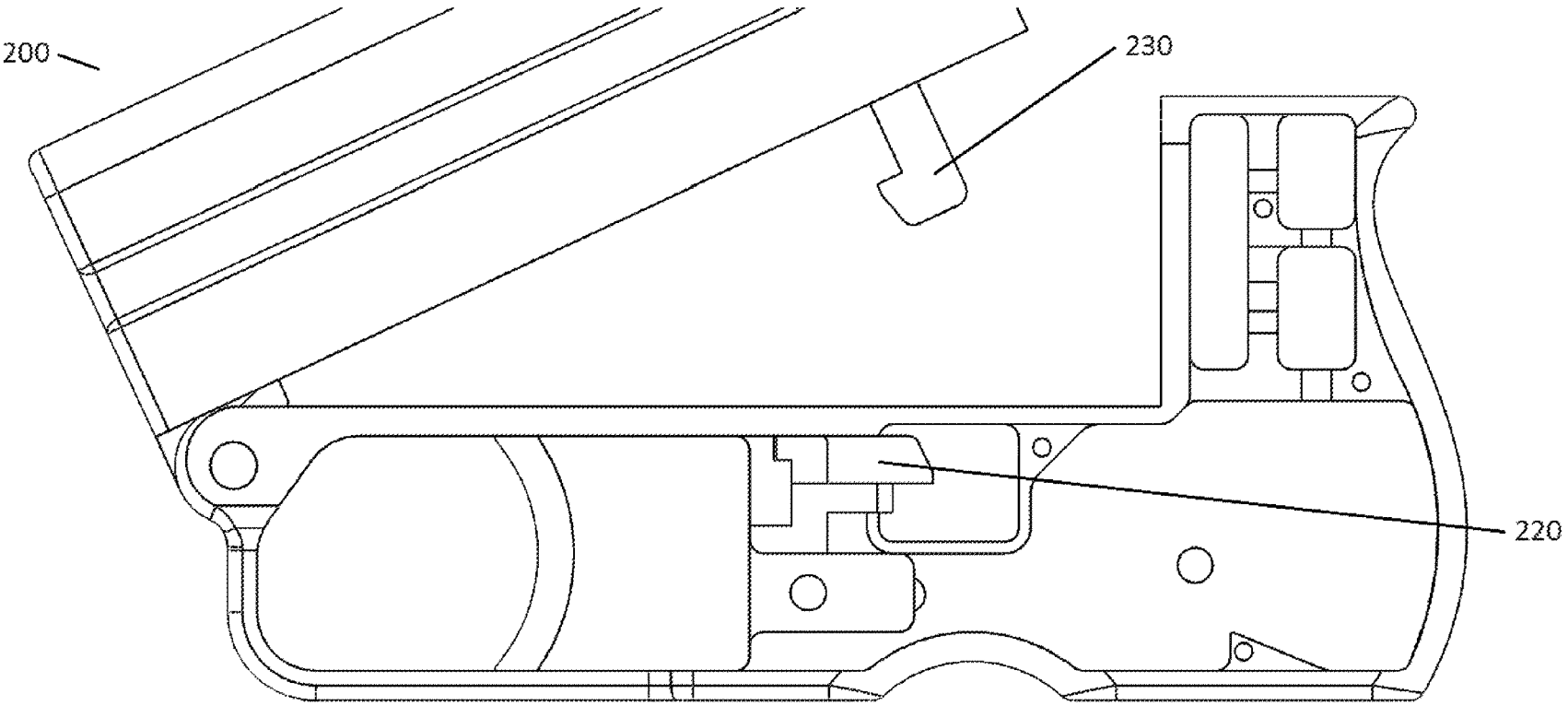
FIG. 17 depicts an embodiment of a firearm, wherein a barrel is rotated away from the body of firearm, according to an embodiment

FIG. 16 depicts an embodiment of firearm 200, wherein barrel lock 220 is released. FIG. 17 depicts an embodiment of firearm 200, wherein barrel 230 is rotated away from the body of firearm 200. Elements depicted in FIGS. 16 and 17 may be described above. For the sake of brevity, a further description of these elements is omitted.

As depicted in FIG. 16, barrel lock 220 may be disengaged from a lip of barrel 230 by a button or other mechanism being pressed to move the overhang associated with barrel lock 220 forward. In other words, an overhang associated with barrel lock 220 may no longer be positioned over the lip of barrel 230. Thus, the overhang associated with barrel lock 220 may be disengaged with the lip of barrel 230.

Responsive to barrel lock 220 and the lip of barrel 230 no longer being engaged, barrel 230 may rotate upwards, as shown in FIG. 17. Barrel 230 may rotate upward via a hinge positioned on first end 110 of firearm housing 110. If the button is no longer being pressed, the overhang associated with barrel lock 220 may once again be positioned over the lip of barrel 230.

Figure 18:
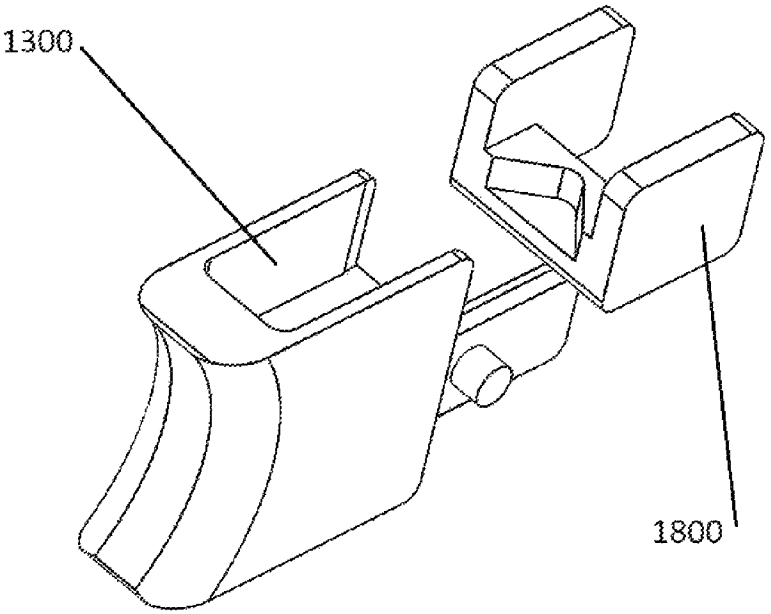
FIGS. 18-20 depict various views of a barrel lock and a locking button, according to an embodiment.

FIGS. 18-20 depict various views of barrel lock 220 and locking button 1800, according to an embodiment. Elements depicted in FIGS. 18-20 may be described above. For the sake of brevity, a further description of these elements is omitted.

As depicted in FIGS. 18-20 once locking button 1800 is pressed from either side, barrel lock 220 may be pushed forward because barrel lock 220 sits on a v-shaped groove within button 1800. This may allow barrel 230 to be released and rotate upward.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A palm firearm, comprising:

a first barrel extending from a distal end of the palm firearm towards a proximal end of the palm firearm;

a second barrel extending from the distal end of the palm firearm toward the proximal end of the palm firearm, the first barrel being vertically offset from the second barrel, a first firing pin corresponding to the first barrel;

a second firing pin corresponding to the second barrel;

a first pin selector positioned on a vertical selector, the first firing pin selector corresponding with the first firing pin, the first pin selector being a first projection extending away from the vertical selector in a first direction and a third direction;

a second pin selector positioned on the vertical selector, the second selector corresponding with the second firing pin, the second pin selector being a second projection extending away from the vertical selector in a second direction and a fourth direction, wherein the first direction and the third direction are perpendicular to the second direction and the fourth direction.

2. The palm firearm of claim 1, further comprising:

a turning post positioned on a first end of the vertical selector, the turning post being configured to rotate the vertical selector responsive to a trigger being pressed.

3. The palm firearm of claim 2, wherein responsive to the trigger being pressed a first time the turning post is configured to rotate the vertical selector ninety degrees to align the first pin selector with the first firing pin and to misalign the second pin selector with the second firing pin.

4. The palm firearm of claim 3, wherein responsive to the trigger being pressed a second time the turning post is configured to rotate the vertical selector ninety degrees to align the second pin selector with the second firing pin and to misalign the first pin selector with the first firing pin.

5. The palm firearm of claim 2, wherein the turning post includes a plurality of posts, each of the posts including a front surface with a planar sidewall and a rear surface with an angled sidewall.

6. The palm firearm of claim 5, further comprising:

a turner configured to move in a linear axis from the distal end of the palm firearm towards the proximal end of the palm firearm to rotate the turning post responsive to the trigger being pressed.

7. The palm firearm of claim 6, wherein the turner includes an upwardly angled arm that is configured to push the front surface of a first of the plurality of posts, and to slide under the rear surface of the first of the plurality of the posts.

8. The palm firearm of claim 1, further comprising:

a hammer being configured to vertically move the vertical selector.

9. The palm firearm of claim 8, wherein the hammer is substantially "Y" shaped with three prongs.

10. The palm firearm of claim 9, wherein a first prong of the hammer is coupled with an actuator, a second prong of the hammer is coupled with a hammer pawl, and a third prong of the hammer is configured to vertically move the vertical selector.

11. A method utilizing a palm firearm, comprising:

aligning a first firing pin with a first barrel, the first barrel extending from a distal end of the palm firearm towards a proximal end of the palm firearm;

aligning a second firing pin with a second barrel, the second barrel extending from the distal end of the palm firearm toward the proximal end of the palm firearm, the first barrel being vertically offset from the second barrel;

turning a vertical selector to align a first pin selector with the first firing pin, and to misalign a second pin selector with the second firing pin, the first pin selector being a first projection extending away from the vertical selector in a first direction and a third direction, the second pin selector being a second projection extending away from the vertical selector in a second direction and a fourth direction, wherein the first direction and the third direction are perpendicular to the second direction and the fourth direction.

12. The method of claim 11, further comprising:

pressing a trigger a first time, wherein the vertical selector is rotated via a turning post positioned on a first end of the vertical selector, the turning post being configured to rotate the vertical selector responsive to the trigger being pressed.

13. The method of claim 12, further comprising:

rotating the turning post ninety degreed responsive to the trigger being pressed the first time the turning post is configured to rotate the vertical selector ninety degrees to align the first pin selector with the first firing pin and to misalign the second pin selector with the second firing pin.

14. The method of claim 13, further comprising:

pressing the trigger a second time to rotate the vertical selector ninety degrees to align the second pin selector with the second firing pin and to misalign the first pin selector with the first firing pin.

15. The method of claim 12, wherein the turning post includes a plurality of posts, each of the posts including a front surface with a planar sidewall and a rear surface with an angled sidewall.

16. The method of claim 15, further comprising:

moving a turner in a linear axis from the distal end of the palm firearm towards the proximal end of the palm firearm to rotate the turning post responsive to the trigger being pressed.

17. The method of claim 16, wherein the turner includes an upwardly angled arm, pushing, via the upwardly angled arm, the front surface of a first of the plurality of posts, and sliding the upwardly angled arm under the rear surface of the first of the plurality of the posts.

18. The method of claim 11, further comprising:

moving the vertical selector via a hammer.

19. The method of claim 18, wherein the hammer is substantially "Y" shaped with three prongs.

20. The method of claim 19, wherein a first prong of the hammer is coupled with an actuator, a second prong of the hammer is coupled with a hammer pawl, and a third prong of the hammer is configured to vertically move the vertical selector.

* * * * *